US007642983B2

(12) United States Patent
Davis

(10) Patent No.: US 7,642,983 B2
(45) Date of Patent: Jan. 5, 2010

(54) HIGH EFFICIENCY FERRITE ANTENNA SYSTEM

(75) Inventor: Steven Jay Davis, Hermosa Beach, CA (US)

(73) Assignee: PowerQ Technologies, Inc., Irvine, CA (US)

( * ) Notice: Subject to any disclaimer, the term of this patent is extended or adjusted under 35 U.S.C. 154(b) by 189 days.

(21) Appl. No.: 11/627,599

(22) Filed: Jan. 26, 2007

(65) Prior Publication Data

US 2007/0222695 A1 Sep. 27, 2007

Related U.S. Application Data

(60) Provisional application No. 60/764,139, filed on Jan. 31, 2006.

(51) Int. Cl.
*H01Q 7/08* (2006.01)

(52) U.S. Cl. ..... 343/788; 343/745; 343/787

(58) Field of Classification Search ..... 343/722, 343/745, 749, 787, 788
See application file for complete search history.

(56) References Cited

U.S. PATENT DOCUMENTS

| | | | | | |
|---|---|---|---|---|---|
| 4,117,493 | A * | 9/1978 | Altmayer | ..... | 343/750 |
| 4,712,112 | A * | 12/1987 | Carr | ..... | 343/788 |
| 4,903,034 | A * | 2/1990 | Kropielnicki et al. | ..... | 343/704 |
| 4,984,296 | A * | 1/1991 | Schotz | ..... | 455/193.3 |
| 6,529,169 | B2 * | 3/2003 | Justice | ..... | 343/788 |

* cited by examiner

*Primary Examiner*—Tho G Phan
(74) *Attorney, Agent, or Firm*—Townsend and Townsend and Crew LLP

(57) ABSTRACT

An automatic tuning procedure can be used to allow a small, high efficiency ferrite antenna assembly to be used in various FM frequency based devices. The ferrite antenna can take the form of a rod or flat disk, for example, which can use a pick-up coil and tuning coil to provide sufficient signal strength using a small FM antenna. A balanced amplifier can be used to provide differential input in order to further reduce noise. A microcontroller can determine the strength of the FM signal at various frequencies and can automatically tune the operating frequency to optimize system performance.

9 Claims, 5 Drawing Sheets

Simulation of Induced Voltage for ROD pickup Coil

| Distance along rod | Field strength in v/m | Distance in meters between points |
|---|---|---|
| -1.06E-03 | 3.19E+00 | |
| -1.31E-05 | 3.42E+00 | 1.04E-03 |
| 1.03E-03 | 3.41E+00 | 1.04E-03 |
| 2.08E-03 | 7.35E-01 | 1.04E-03 |
| 3.12E-03 | 5.76E-01 | 1.04E-03 |
| 4.17E-03 | 3.58E-01 | 1.04E-03 |
| 5.21E-03 | 3.19E+00 | 1.04E-03 |
| 6.25E-03 | 3.26E+00 | 1.04E-03 |
| 7.30E-03 | 3.00E+00 | 1.04E-03 |
| 8.34E-03 | 4.53E-01 | 1.04E-03 |
| 9.39E-03 | 4.44E-01 | 1.04E-03 |
| 1.04E-02 | 2.08E+00 | 1.04E-03 |
| 1.15E-02 | 2.89E+00 | 1.04E-03 |
| 1.25E-02 | 2.89E+00 | 1.04E-03 |
| 1.36E-02 | 2.10E+00 | 1.04E-03 |
| 1.46E-02 | 4.51E-01 | 1.04E-03 |
| 1.57E-02 | 4.56E-01 | 1.04E-03 |
| 1.67E-02 | 2.88E+00 | 1.04E-03 |
| 1.77E-02 | 3.14E+00 | 1.04E-03 |
| 1.88E-02 | 3.07E+00 | 1.04E-03 |
| 1.98E-02 | 3.47E-01 | 1.04E-03 |
| 2.09E-02 | 5.83E-01 | 1.04E-03 |
| 2.19E-02 | 7.73E-01 | 1.04E-03 |
| 2.30E-02 | 3.62E+00 | 1.04E-03 |
| 2.40E-02 | 3.63E+00 | 1.04E-03 |
| 2.51E-02 | 3.38E+00 | |

Total induced voltage in 1 volt/meter filed is

This is just the sum of the voltages along the coil, which is: 5.32E-02 volts (1 volt / meter field). In a 50-uv/m field (low received signal) the voltage induced would be 2.66 microvolts.

FIG. 6

Simulation of a Flat Disk

| Distance along Perimeter | volts/meter | Distance between Points |
|---|---|---|
| -2.45E-02 | 3.90E+01 | |
| -2.35E-02 | 5.95E+00 | 1.00E-03 |
| -2.25E-02 | 3.52E+00 | 1.00E-03 |
| -2.15E-02 | 3.12E+01 | 1.00E-03 |
| -2.05E-02 | 3.02E+01 | 1.00E-03 |
| -1.95E-02 | 2.97E+01 | 1.00E-03 |
| -1.85E-02 | 1.36E+00 | 1.00E-03 |
| -1.75E-02 | 1.35E+00 | 1.00E-03 |
| -1.65E-02 | 2.90E+01 | 1.00E-03 |
| -1.55E-02 | 2.89E+01 | 1.00E-03 |
| -1.45E-02 | 2.88E+01 | 1.00E-03 |
| -1.35E-02 | 2.88E+01 | 1.00E-03 |
| -1.25E-02 | 1.51E+00 | 1.00E-03 |
| -1.15E-02 | 1.53E+00 | 1.00E-03 |
| -1.05E-02 | 1.54E+00 | 1.00E-03 |
| -9.50E-03 | 2.89E+01 | 1.00E-03 |
| -8.50E-03 | 2.90E+01 | 1.00E-03 |
| -7.50E-03 | 1.49E+00 | 1.00E-03 |
| -6.50E-03 | 1.44E+00 | 1.00E-03 |
| -5.50E-03 | 1.35E+00 | 1.00E-03 |
| -4.50E-03 | 2.98E+01 | 1.00E-03 |
| -3.50E-03 | 3.03E+01 | 1.00E-03 |
| -2.50E-03 | 3.11E+01 | 1.00E-03 |
| -1.50E-03 | 5.17E-01 | 1.00E-03 |
| -5.00E-04 | 2.87E+01 | 1.00E-03 |
| 5.00E-04 | 2.97E+01 | 1.00E-03 |
| 1.50E-03 | 4.99E-01 | 1.00E-03 |
| 2.50E-03 | 8.51E-01 | 1.00E-03 |
| 3.50E-03 | 3.13E+01 | 1.00E-03 |
| 4.50E-03 | 3.07E+01 | 1.00E-03 |
| 5.50E-03 | 3.04E+01 | 1.00E-03 |
| 6.50E-03 | 1.56E+00 | 1.00E-03 |
| 7.50E-03 | 1.63E+00 | 1.00E-03 |
| 8.50E-03 | 2.99E+01 | 1.00E-03 |
| 9.50E-03 | 2.98E+01 | 1.00E-03 |
| 1.05E-02 | 2.97E+01 | 1.00E-03 |
| 1.15E-02 | 2.97E+01 | 1.00E-03 |
| 1.25E-02 | 2.97E+01 | 1.00E-03 |
| 1.35E-02 | 2.97E+01 | 1.00E-03 |
| 1.45E-02 | 2.97E+01 | 1.00E-03 |
| 1.55E-02 | 2.98E+01 | 1.00E-03 |
| 1.65E-02 | 2.99E+01 | 1.00E-03 |
| 1.75E-02 | 1.72E+00 | 1.00E-03 |
| 1.85E-02 | 1.78E+00 | 1.00E-03 |
| 1.95E-02 | 1.91E+00 | 1.00E-03 |
| 2.05E-02 | 2.20E+00 | 1.00E-03 |
| 2.15E-02 | 2.79E+00 | 1.00E-03 |
| 2.25E-02 | 3.38E+01 | 1.00E-03 |
| 2.35E-02 | 6.35E+00 | 1.00E-03 |
| 2.45E-02 | 4.01E+01 | 1.00E-03 |

Total voltage induced 9.30E+02 in 1 volt/meter field
Total voltage induced in a 50 uv/meter filed would be : 46.5 microvolts.

FIG. 7

HIGH EFFICIENCY FERRITE ANTENNA SYSTEM

CROSS-REFERENCE TO RELATED APPLICATIONS

This application claims priority to U.S. Provisional Patent Application Ser. No. 60/764,139, filed Jan. 31, 2006, entitled "HIGH EFFICIENCY FERRITE ANTENNA SYSTEM," which is hereby incorporated herein by reference.

BACKGROUND OF THE INVENTION

An increasing number of automobiles and other vehicles are including devices such as navigation systems, which use satellite or GPS information to track and provide navigation information to the driver. Some of these systems also provide additional "real-time" information, such as traffic information or gas price information, which is added on top of the geographic data displayed to the driver. While some systems utilize satellite radio signals, others utilize common FM frequencies. When common FM frequencies are used, a common quarter-wave antenna typically is needed to pick up the signal with acceptable strength. Since an FM frequency of about 100 MHz has a quarter wavelength of about 31 inches, this typically requires accessing the automobiles' rod antenna, or an antenna directed through the front or rear window in order to obtain acceptable length.

Accessing this antenna typically requires a rewiring of the car, first disconnecting the antenna and then wiring the radio and navigation system to share the antenna. As navigation systems presently are installed primarily in newer and more expensive cars, people may be reluctant to have the internal wiring redone by an outside vendor. Further, such rewiring can void the warranty on the radio and/or wiring system, and can be somewhat expensive. Some manufacturers use proprietary devices, such as amplifiers and amplifier systems, which may not function properly after such an installation. Further still, sharing the antenna can result in a reduction in quality of the existing radio, as the shared antenna typically introduces additional noise into the FM signal input to the radio.

Even in simple FM radios or other FM-frequency devices, it is common to require a quarter-wave antenna. In automobiles, these antennas are subject to breakage and can be somewhat unsightly. The antennas can be included in the glass or other areas or devices of the vehicles, but this increases the cost and complexity of these parts. In handheld FM radios, the earphone wires often are used as the antenna, which has not proven to provide optimal reception. Further, portable radios often require an extendable antenna, which may not be practical for systems places in areas with minimal space, such as a bookshelf or cabinet.

It therefore is desirable to obtain a method of receiving FM signals that does not require a large quarter-wave antenna, and that allows separate devices to easily include their own antennas without the need to share a large antenna.

BRIEF SUMMARY OF THE INVENTION

Systems and methods in accordance with various embodiments of the present invention provide for the automatic tuning of a small antenna for FM frequency devices.

In one embodiment, an antenna assembly includes a ferrite rod, such as a rod of about an inch in length or less. A single turn tuning coil is wound about a first portion of the ferrite rod. The single turn tuning coil can receive a tuning frequency and adjust the resonant frequency of the ferrite rod in response thereto. A multi-turn pick-up coil is wound about a second portion of the ferrite rod. The multi-turn pick-up coil can have a voltage induced thereon by a received FM signal at about the adjusted resonant frequency. The multi-turn pick-up coil can provide the received FM signal as output.

In another embodiment, an antenna assembly includes a substantially flat ferrite disk, such as a disk on the order of about 40 mm in length by about 40 m in width. A pick-up coil is placed around a periphery of the ferrite disk. The pick-up coil can have a voltage induced thereon by a received FM signal at a resonant frequency of the ferrite disk. The pick-up coil can provide the received FM signal as output. The assembly also can have a tuning coil positioned about the periphery of the ferrite disk, operable to receive a tuning frequency and adjust the resonant frequency of the ferrite disk in response thereto.

Such antenna assemblies can be used with a variety of antenna systems. In one embodiment, such an antenna is used with an amplifier device operable to receive an FM signal induced on the pick-up coil and provide the FM signal as an amplified FM signal. An FM receiver is operable to receive the amplified FM signal. A microcontroller in communication with the FM receiver can determine a strength of the amplified FM signal. The microcontroller then can output a tuning frequency to the tuning coil in order to adjust a resonant frequency of the ferrite antenna. The microcontroller also can send a control signal to the FM receiver to adjust an operating frequency of the FM receiver to the adjusted resonant frequency.

Other embodiments will be obvious to one of ordinary skill in the art in light of the description and figures contained herein.

BRIEF DESCRIPTION OF THE DRAWINGS

Various embodiments in accordance with the present invention will be described with reference to the drawings, in which:

FIG. 6 illustrates simulated induced voltage data for a rod antenna assembly in accordance with one embodiment of the present invention; and FIG. 7 illustrates simulated induced voltage data for a flat disk antenna assembly in accordance with one embodiment of the present invention.

DETAILED DESCRIPTION OF THE INVENTION

Systems and methods in accordance with various embodiments of the present invention can overcome these and other deficiencies in existing FM antenna applications by providing for reduced antenna sizes that can be automatically tuned to provide desirable results. In one embodiment, a ferrite rod or disk antenna can be used with a microcontroller system to provide an antenna that is about an inch in length that can easily be incorporated into a device such as an FM radio or navigation system. The microcontroller can provide for automatic tuning of the antenna at various FM frequencies. The antennas themselves provide characteristics allowing the systems to provide the necessary signal strengths, with sufficiently low signal to noise ratios, when properly tuned using the microcontroller system. Such antennas can be used in any application where it is desirable to utilize a small antenna for bands with relatively long wavelengths, such as FM bands.

Figure 1:
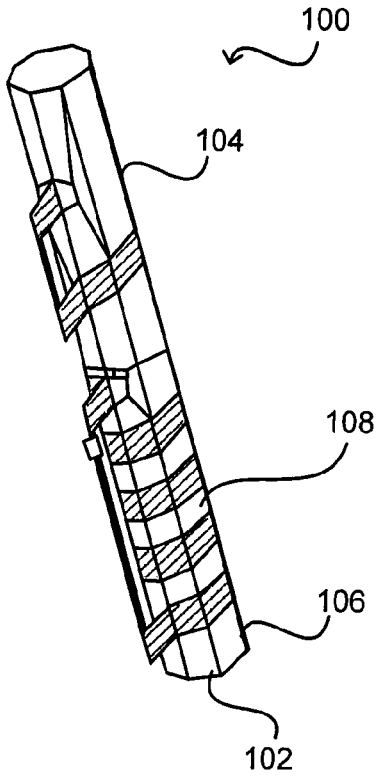
FIG. 1 illustrates a rod antenna assembly that can be used in accordance with one embodiment of the present invention.

For example, FIG. 1 illustrates a rod antenna assembly 100 that can be used in accordance with one embodiment of the present invention. In contrast with existing antennas that are typically about 750 mm in length for a 100 MHz signal, such an antenna assembly can be significantly smaller, such as on the order of 45 mm long and 8 mm in diameter for one exemplary assembly. These physical dimensions can be altered to meet the specific application, and to provide different signal strengths. While larger antennas can provide greater signal strength, it can be desirable to keep the antennas less than two or three inches in length in order to fit the antenna in a device or space within a radio or other FM device. Smaller antennas can be used as well, but the desire for a minimum number of windings as discussed below can place a physical limitation on the minimum size of such an antenna.

As shown in the example of FIG. 1, a rod antenna can include a rod 102 of an appropriate material at least partially surrounded by two coils, referred to herein as a tuning coil 104 and a pick-up coil 106. The tuning coil 104 in this example is a single turn coil of an appropriate conductive material, such as copper wire or copper tape as known in the art. The tuning coil can be used to tune the antenna to a specific frequency as discussed below. A device such as a varactor diode can be used to tune the tuning coil by placing the diode across the ends of the single coil. This varactor can be adjusted by a microcontroller or other device as discussed below.

The pick-up coil 106 is a multi-turn coil which can have a voltage induced thereon by an FM signal that can be supplied to a high impedance RF Amplifier as discussed below. The magnitude of this voltage can be a function of the number of turns and the permeability of the material used for the rod 102. The number of turns can limited by the physical size of the rod, as discussed above, as well as the inter-winding capacitance. Using too many turns can cause the coil to essentially be shorted out by the capacitance. In this embodiment, four turns were found to be optimal for a ferrite rod of the above-referenced dimensions. A discussion of the performance of an antenna assembly based on the number of turns will be discussed below. The coil can be tapped to provide a balanced input to a differential RF amplifier as discussed in further detail below, in order to reduce local noise pickup and improve performance.

The exemplary rod antenna assembly 100 also utilizes flat copper tape in the coils. The copper tape was found to increase the efficiency of the antenna relative to copper wire. At high frequencies, the current in a wire travels essentially on the surface of the wire. To reduce resistance (ohmic loss) in wire, it typically is necessary to increase the diameter of the wire to increase the surface area on which the charge can travel. A wire with a diameter of 2 mm would have a circumference of approximately 6 mm. Copper tape, on the other hand, typically will have current flowing on both faces of the wire (the faces of the tape having larger widths than the sides), such that a 3 mm wide copper tape will have about the same loss as the 2 mm wire, but can have a thickness that is substantially smaller than the 2 mm diameter of the wire. The use of copper tape also can simplify production, as adhesive tape is readily available and can easily be applied to the rod in the desired shape. Copper wire can require a coil form to maintain its shape. Also, having the current closer to the ferrite material can increase the performance of the antenna assembly, as on a wire one half of the current is, on average, a radius away from the ferrite material, thereby reducing the effectiveness of the ferrite. The voltage induced across the pick-up coil, due to the received FM frequency, can be supplied to the receiver inputs. Simulations (confirmed by experiment) show the voltage for such an antenna assembly to be approximately 2.7 μV for a 50 μV/m field.

While the rod is shown to be octagonal in cross-section, it should be understood that any of a number of other shapes and forms can be used, as dictated by the application and/or manufacturing process. For example, the rod can be circular, hexagonal, elliptical, or any other appropriate shape in cross section. Further, while two coils are used in this embodiment, a single coil can be used where space or other limitations or design choices do not allow or provide for a dual coil. Using a dual coil can allow for the antenna to be tuned independently from the pickup coil, allowing the pickup coil to be arranged in single ended or in a balanced mode to optimize performance.

Figure 2:
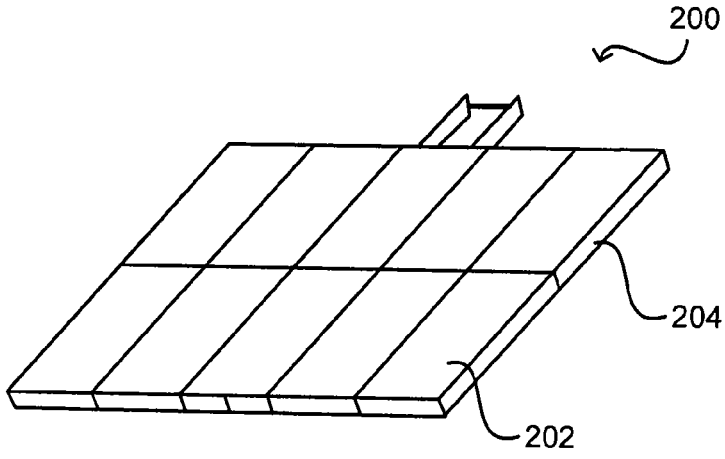
FIG. 2 illustrates a flat disk antenna assembly that can be used in accordance with one embodiment of the present invention.

FIG. 2 shows an antenna assembly 200 in accordance with another embodiment. In this embodiment, the antenna assembly is based around a flat disk 202 of a material, such as ferrite. The disk 202 can be of any appropriate shape, such as a circular, elliptical, or rectangular shape, but here is shown to comprise a square-shaped disk having dimensions on the order of about 40 mm×40 mm×3 mm. A thin disk antenna device can provide several improvements over a rod antenna for various applications. While the figure appears to include segmented regions, the disk typically will be a solid piece of material. The segmenting in the figure is used for simulations, where the ferrite body is segmented to obtain more accurate results than would be obtained using the same simulation on a single, larger segment.

For example, a square disk typically will have an increased area of signal capture, which can provide similar received signal levels in a much smaller volume. The coil 204 used to tune the antenna can be placed along the edge of the disk. This perimeter coil then can be tuned to maximize the Q and minimize the loss of the antenna, the Q (quality factor) and loss of an antenna being known to one of ordinary skill in the art. This coil then can be used as the pick-up coil. Alternatively, a second multi-turn coil (not shown) can be placed around the body of the disk. The flat design can actually enable circuitry to be placed on top of, or adjacent to, the ferrite disk since the ferrite is non-conductive. Simulations show similar antenna gains with such an approach.

The coil 204 can be a strip of material, such as copper, placed about the perimeter of a flat piece of ferrite material, for example. The copper tape could be replaced by a metal frame, which could provide a mechanical method for securing the disk to a corresponding enclosure of the device. The coil also may take other forms, such as a wire or wire grid. In a simulation for an assembly using a copper strip about the periphery, the induced voltage across the pick-up point was found to be around 46 μV, almost 20 times the induced voltage for the rod assembly. For many applications where a flat disk antenna can be used, the flat disk can provide improved performance over a rod antenna assembly. A similar tuning and amplifier arrangement can be used for a flat disk assembly as for a rod assembly, except that the varactor for the flat disk may be placed across the tuning coil.

A device using a rod, disk, or other antenna assembly as described elsewhere herein can advantageously utilize a microcontroller system in accordance with various embodiments of the present invention. Such a microcontroller system can be used to automatically tune the coil of the respective antenna without manually adjusting the coil itself, as in many existing antenna systems. Such a system can be used to control and integrate a high frequency (100 MHz) ferrite antenna in a small FM-frequency based device, such as a small inexpensive FM radio or a portable GPS device. By automatically optimizing the ferrite tuning using a microcontroller system, the tuning can compensate for factors such as aging, temperature change, and production tolerances.

Figure 3:
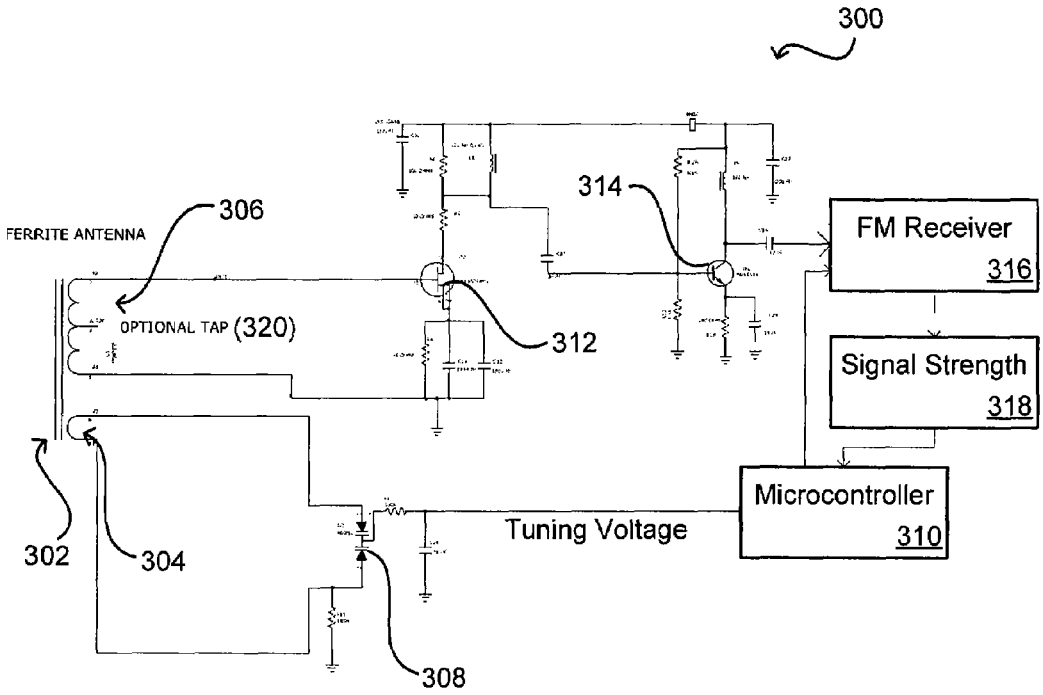
FIG. 3 illustrates a broadband amplifier and microcontroller circuit that can be used in accordance with one embodiment of the present invention.

FIG. 3 includes a diagram showing components of an exemplary microcontroller and amplifier circuit 300. As shown, the circuit includes two coils in contact with an antenna structure 302, including a tuning coil 304 for tuning the antenna and a pick-up coil 306 for "picking up" an FM signal. The tuning coil 304, here shown to be a single coil, is connected with a varactor diode 308 that acts as a variable cap to allow for tuning of the ferrite. The tuning coil can be resonated at the frequency to be received, such as at 100 MHz, via an applied tuning voltage. The tuning voltage can be received from a digital download converter on the microcontroller 310. The tuning voltage can be adjusted until the voltage is peaked, or tuned, to the desired frequency.

The pick-up coil 306 is shown to be a four turn coil, although different numbers of turns can be used for different applications. As discussed elsewhere herein, additional turns can help to increase the amount of signal received by the coil as known in the art. The pick-up coil can be connected with high impedance RF amplifier circuitry, allowing the voltage induced on the pick-up coil due to the received FM signal to be amplified and provided as input to an FM frequency receiver 316. As shown in this example, the amplifier circuit can include a two-stage amplifier including a common source Field Effect Transistor (FET) stage 312 and a common emitter Bi-polar Junction Transistor (BJT) stage 314, although any appropriate amplifier or amplifier circuitry can be used as known in the art. In this example, the common source FET stage can achieve a high input impedance for the amplifier, while the BJT stage can use a voltage divider bias to provide additional voltage gain and proper matching to the low impedance of the FM receiver input. The transistors 314, 316 and associated circuitry can form a broadband amplifier that is effective over the entire band of interest and does not need to be tuned. The transistors in this embodiment have low noise figures at 100 MHz.

In such a circuit, a ferrite antenna can be used as the main tuning element. The only signal applied to the circuit from the microcontroller in this embodiment is the signal used for tuning the ferrite. As discussed above, the amplifier circuit can be used to provide for impedance matching. In one example, the impedance of a ferrite rod antenna is on the order of about 5,000 to 10,000 Ohms, while the impedance of a standard, single chip FM receiver can be on the order of about 100 Ohms. The dual amplifier can adjust the impedance levels to match the impedance of the FM receiver input(s).

Figure 4:
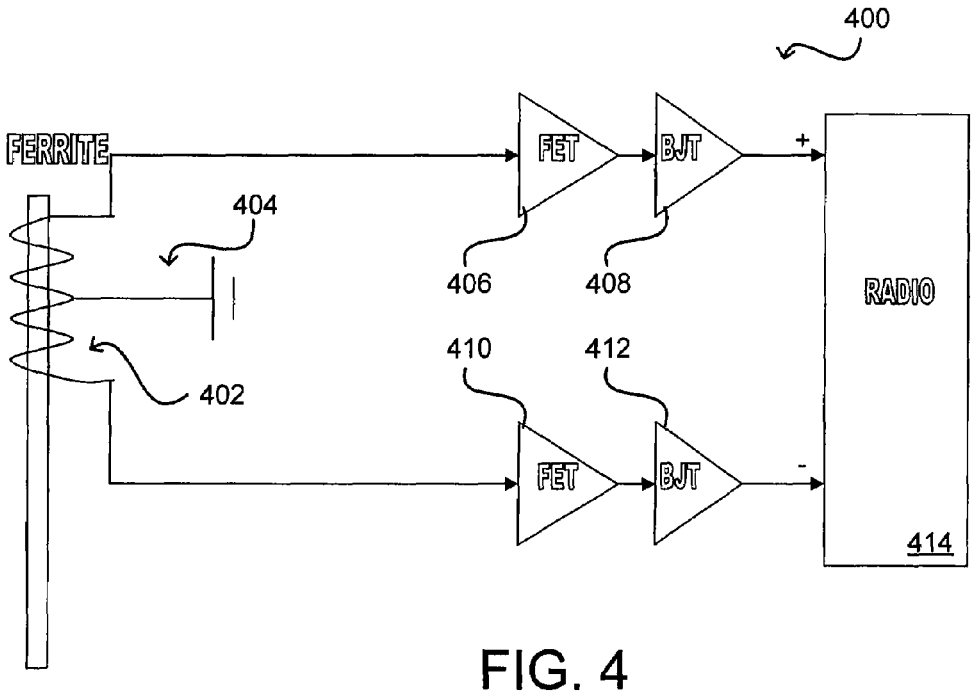
FIG. 4 illustrates a balanced amplifier design that can be used in accordance with one embodiment of the present invention.

Also shown is an optional tap 320 that can allow for the implementation of a balanced amplifier. FIG. 4 illustrates an exemplary balanced amplifier circuit 400 including a pair of two-stage amplifier arms, each including a FET stage and a BJT stage as discussed above. The remainder of the components of the circuit can remain substantially the same, but doubled where appropriate for each arm of the balanced amplifier circuit. A pick-up coil 402 with a tap 404 is shown to be connected to a first arm containing a first set of FET 406 and BJT 408 transistors to provide input to a positive input terminal of an FM receiver 414, as well as being connected to a second arm containing a second set of FET 410 and BJT 412 transistors to provide input to a negative input terminal of an FM receiver 416. Using such a differential amplifier approach can help to remove local noise from the radio board. The differential coil offers essentially a built in balun that is capable of rejecting common mode noise typically generated in a radio or similar device. The balanced mode utilizes the duplicate RF amplifier to couple the differential input of a radio chip, for example. In applications where common noise is not an issue, this tap can be left open and a single amplifier can be used.

As shown in FIG. 3, the FM receiver receiving the amplified FM signal can provide as output a signal that is input to a signal strength indicator module 318. It should be understood that the signal strength indicator module can be separate from, or part of, the receiver chip or receiver device 316. The signal strength indicator module 318 can provide a signal that is indicative of the strength of the received FM signal, which can be received as input to the microcontroller block 310. The microcontroller block can use the strength signal, along with microcontroller instructions and/or other data, to select and output the tuning voltage that is applied to the varactor diode 308 for tuning the antenna. The microcontroller also can output a frequency indicator signal that is fed back to the FM receiver block 316, indicating the active frequency to which the receiver should tune in order to receive an optimal signal. For example, the frequency indicator signal could instruct the receiver to tune to a frequency of 101.1 MHz. Once the receiver has adjusted, the microcontroller can again look at the signal strength and can adjust the tuning as appropriate to maximize the signal. This process can continue over time, allowing the device to automatically and continually tune the operating frequency of the device. Even when no signal is present at the operating frequency, there will an amount of noise that can be used for the optimization. Using the microcontroller to sense an optimal tuning arrangement can provide desirable performance improvements over existing approaches, such as where a variable cap is used that has to be re-tuned every time the frequency is changed. The microcontroller can adjust the circuit automatically as the frequency is tuned (such as by moving across the FM band in a radio).

Accordingly, the following process includes steps for automatically tuning an antenna system for an FM radio in accordance with one embodiment. In this process, the FM radio is set to the desired frequency using the microcontroller. An analog voltage is applied from the microcontroller using a D/A converter or a pulse width modulation (PWM) signal whose average value is the desired tuning voltage. The tuning voltage can be swept from a minimum voltage level to a maximum voltage level, with the received signal level being measured over that range. Alternatively, a binary search routine can be used to save time, as known in the art. After each step in the sweep, the radio circuitry can be allowed to settle, such as by waiting on the order of a few milliseconds. The point where the signal level was a maximum then can be recorded or otherwise stored. The tuning voltage can be set to the point where the signal level was a maximum. The tuning and frequency indicator signals can be output as discussed above. This process can be repeated at appropriate times, such as after each tuning command, at periodic intervals, or continually. If the system is used in a data receiver application, the error rate of the received data can be used to fine tune the antenna tuning voltage as would be known to one of ordinary skill in the art in light of the disclosure herein.

Figure 5A:
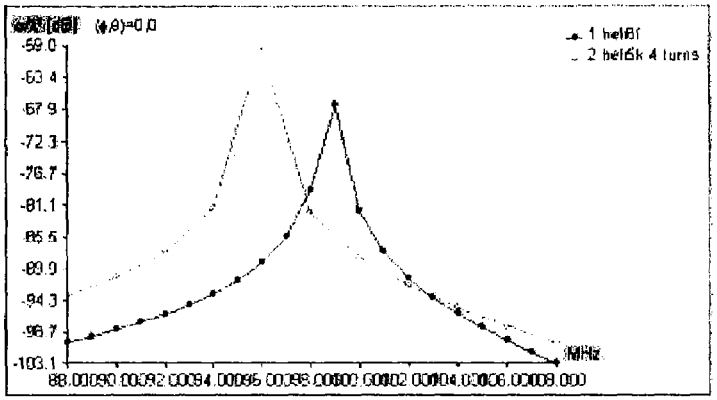
FIGS. 5(*a*)-(*c*) illustrate simulated gain curves for various antenna designs in accordance with one embodiment of the present invention.
Figure 5B:
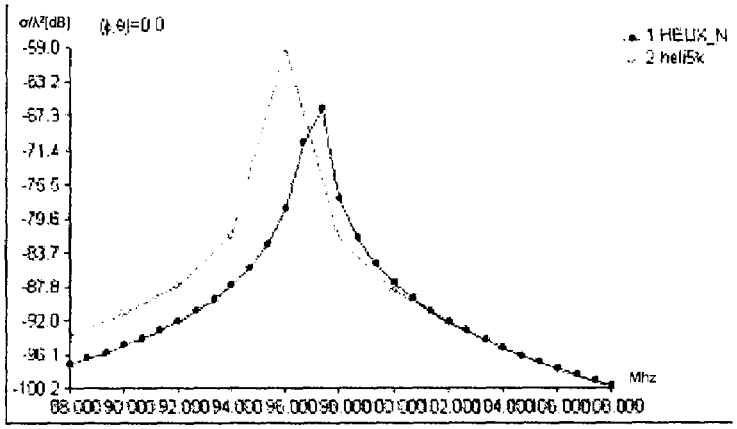
Figure 5C:
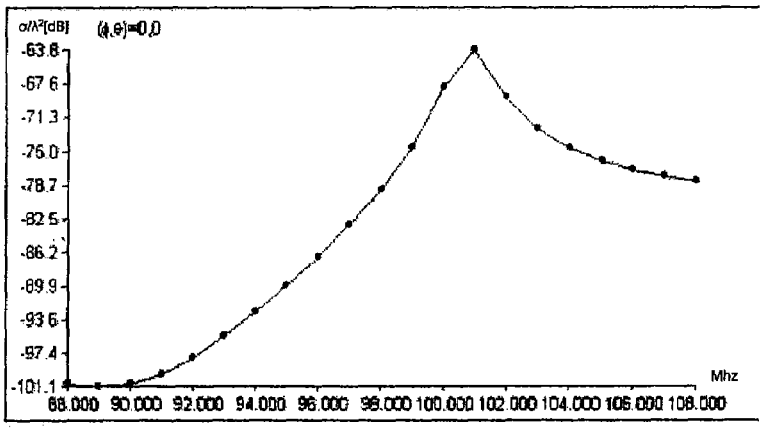

As discussed above, the number of turns of the pick-up coil can affect the performance of the antenna assembly. For example, FIGS. 5(*a*) and 5(*b*) show gain simulations for antenna assemblies including differing numbers of turns. For example, FIG. 5(*a*) shows the improved gain using 4 turns instead of 8 turns for a given antenna assembly. FIG. 5(*b*) shows the improved performance of 4 turns relative to 3 turns in a similar antenna assembly. Additional turns can help to increase the amount of signal received by the coil as known in the art. While it could be desirable to have as many turns as possible, there may be physical limitations (e.g., space, size of wire) that limit the number of turns that can be used, and the performance can degrade if too many turns are used for a given assembly. Further, there can be significant differences between the performance of various antenna assemblies. For example, FIG. 5(*c*) shows a simulated gain curve for a 40 mm×40 mm×3 mm disk in accordance with one embodiment of the present invention. FIG. 6 shows data for a simulation of induced voltage for a rod pickup coil, while FIG. 7 shows data for a simulation of induced voltage for a flat disk assembly. Experimental results confirmed the accuracy of these simulations.

While the above antenna assemblies were described with respect to a ferrite material, there can be other materials with similar permeability and loss properties that can be used in the various embodiments described and suggested herein. The sizes, shapes, and configurations also can vary as would be known to one of ordinary skill in the art. Ferrite antennas have been used extensively in AM radio applications for many years, and more recently some ferrite antennas have been used in paging receivers that operate on the FM radio band, such that ferrite antennas might be readily available and reasonably priced. The difficulty of controlling these antenna systems using existing approaches and the cost of these control systems has generally prevented them from being widely used in the millions of FM radios in the world today. Systems and methods in accordance with embodiments of the present invention can overcome these deficiencies to provide a complete and affordable solution.

Ferrite is described in various embodiments to increase the magnetic field to which the coils are exposed. As discussed above, significant characteristics of the antenna material are the permeability and the loss, which make ferrite an optimal solution for many applications. In one embodiment, Fair-Rite ferrite material 68 is used, available from Fair-Rite Products Corp. of Wallkill, N.Y. The permeability can determine the magnetic magnification while the loss can determine how much of the energy of the field in the ferrite is lost to the generation of heat.

As an alternative to using ferrite material, an antenna assembly in accordance with one embodiment of the present invention utilizes magnetic material sprayed or otherwise deposited, coated, embedded, or connected with a component of the device utilizing the antenna assembly, such as a magnetic coating deposited on the plastic cover of a box used to contain the device. In general, the box can be at least an inch in size to obtain a signal of sufficient strength, although different sizes can be used as appropriate. For many applications, smaller boxes can be more difficult to tune. As the active area of the box is increased, the larger capture area can result in an increase in signal strength. For many applications, however, the desire can be to keep the box as small as possible. In certain embodiments, the performance of the box can reach the performance of the flat disk assemblies.

Embodiments in accordance with the present invention can be implemented using control logic in software or hardware or a combination of both. The control logic may be stored in an information storage medium as a plurality of instructions adapted to direct an information-processing device to perform a set of steps disclosed in embodiments of the present invention. Based on the disclosure and teachings provided herein, a person of ordinary skill in the art will appreciate other ways and/or methods to implement the present invention. Further, although exemplary circuitry and components are shown, it should be understood that there are a number of ways to achieve the objectives of the present invention utilizing the descriptions and teachings of the various embodiments herein that would be obvious to one of ordinary skill in the art in light of the teachings herein.

The above description is illustrative but not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

What is claimed is:

1. An antenna assembly for use with an FM frequency device, comprising:

a ferrite rod;

a single turn tuning coil wound about a first portion of the ferrite rod, the single turn tuning coil operable to receive a tuning frequency and adjust the resonant frequency of the ferrite rod in response thereto; and a multi-turn pick-up coil wound about a second portion of the ferrite rod, the multi-turn pick-up coil capable of having a voltage induced thereon by a received FM signal at the adjusted resonant frequency, the multi-turn pick-up coil being further configured to provide the received FM signal as output.

2. An antenna assembly according to claim 1, wherein:

the at least one of the tuning and pick-up coils is formed of a copper tape.

3. An antenna assembly according to claim 1, wherein:

the ferrite rod is about 1 inch in length.

4. An antenna assembly according to claim 1, wherein:

the multi-turn pick-up coil further includes a tap allowing the output to be applied to a pair of differential amplifiers.

5. An antenna assembly according to claim 1, wherein:

the ferrite disk is about 40 mm in length and about 40 mm in width.

6. An antenna assembly for use with an FM frequency device, comprising:

a substantially flat ferrite disk; and a pick-up coil placed around a periphery of the ferrite disk, the pick-up coil capable of having a voltage induced thereon by a received FM signal at a resonant frequency of the ferrite disk, the pick-up coil being further configured to provide the received FM signal as output.

7. An antenna assembly according to claim 6, further comprising:

a tuning coil positioned about the periphery of the ferrite disk, the tuning coil operable to receive a tuning frequency and adjust the resonant frequency of the ferrite disk in response thereto.

8. An antenna assembly according to claim 7, wherein:

the pick-up coil is formed of a copper tape.

9. An antenna assembly according to claim 7, wherein:

the pick-up coil is formed of a metal frame.

* * * * *